US006981823B2

(12) United States Patent
Roraas et al.

(10) Patent No.: US 6,981,823 B2
(45) Date of Patent: Jan. 3, 2006

(54) METHOD AND ARRANGEMENT FOR INSTALLATION AND REMOVAL OF OBJECTS AT SEA

(75) Inventors: Helge Roraas, Katy, TX (US); Knut Vasstrand, Blommenholm (NO)

(73) Assignee: Aker Marine Contractors AS, Olso (NO)

( * ) Notice: Subject to any disclaimer, the term of this patent is extended or adjusted under 35 U.S.C. 154(b) by 0 days.

(21) Appl. No.: 10/760,704

(22) Filed: Jan. 16, 2004

(65) Prior Publication Data

US 2004/0218983 A1 Nov. 4, 2004

(30) Foreign Application Priority Data

Jan. 17, 2003 (NO) ..... 20030262

(51) Int. Cl.
*E02B 17/00* (2006.01)

(52) U.S. Cl. ..... 405/204; 405/195.1; 405/205; 405/203

(58) Field of Classification Search ..... 405/196, 405/197, 200, 203–209, 195.1
See application file for complete search history.

(56) References Cited

U.S. PATENT DOCUMENTS 4,436,454 A * 3/1984 Ninet et al. ..... 405/204
4,607,982 A 8/1986 Brasted et al.
4,662,788 A * 5/1987 Kypke et al. ..... 405/204
4,761,097 A * 8/1988 Turner ..... 405/204
4,848,967 A * 7/1989 Weyler ..... 405/204
4,930,938 A * 6/1990 Rawstron et al. ..... 405/204
5,219,451 A 6/1993 Datta et al.
5,522,680 A 6/1996 Hoss et al.
6,293,734 B1 * 9/2001 Thomas et al. ..... 405/209

* cited by examiner

*Primary Examiner*—Frederick L. Lagman
(74) *Attorney, Agent, or Firm*—Darby & Darby

(57) ABSTRACT

A method and a suitable arrangement for installation of a deck structure at an offshore location, where the deck structure is put on a vessel at a location inshore, then transported on the vessel to the offshore location and positioned relative to legs (13) of a jacket or gravity base type support structure standing on the sea bottom, or the legs or columns of a floating substructure, the deck structure having deck legs (5) corresponding to support legs (13) on the support structure, the deck legs (5) each being provided with a jack type of mechanism with an associated piston (1) which is extended into contact with and supported by the top part (3) of the corresponding support leg (13) at the beginning of a procedure for transferring the weight of the deck structure from the vessel to the support legs (13). Said procedure comprises ballasting the vessel (12) while permitting wave induced motions of the vessel (12) to further lift the deck structure with respect to the support structure and permitting the pistons (1) to extend further below the respective deck legs (5) when a higher wave is encountered. The pistons (1) are prevented from moving into the respective deck legs (5) during the weight transfer by mechanically locking the pistons (1) in the legs by means of a one-way ratchet type mechanism.

22 Claims, 12 Drawing Sheets

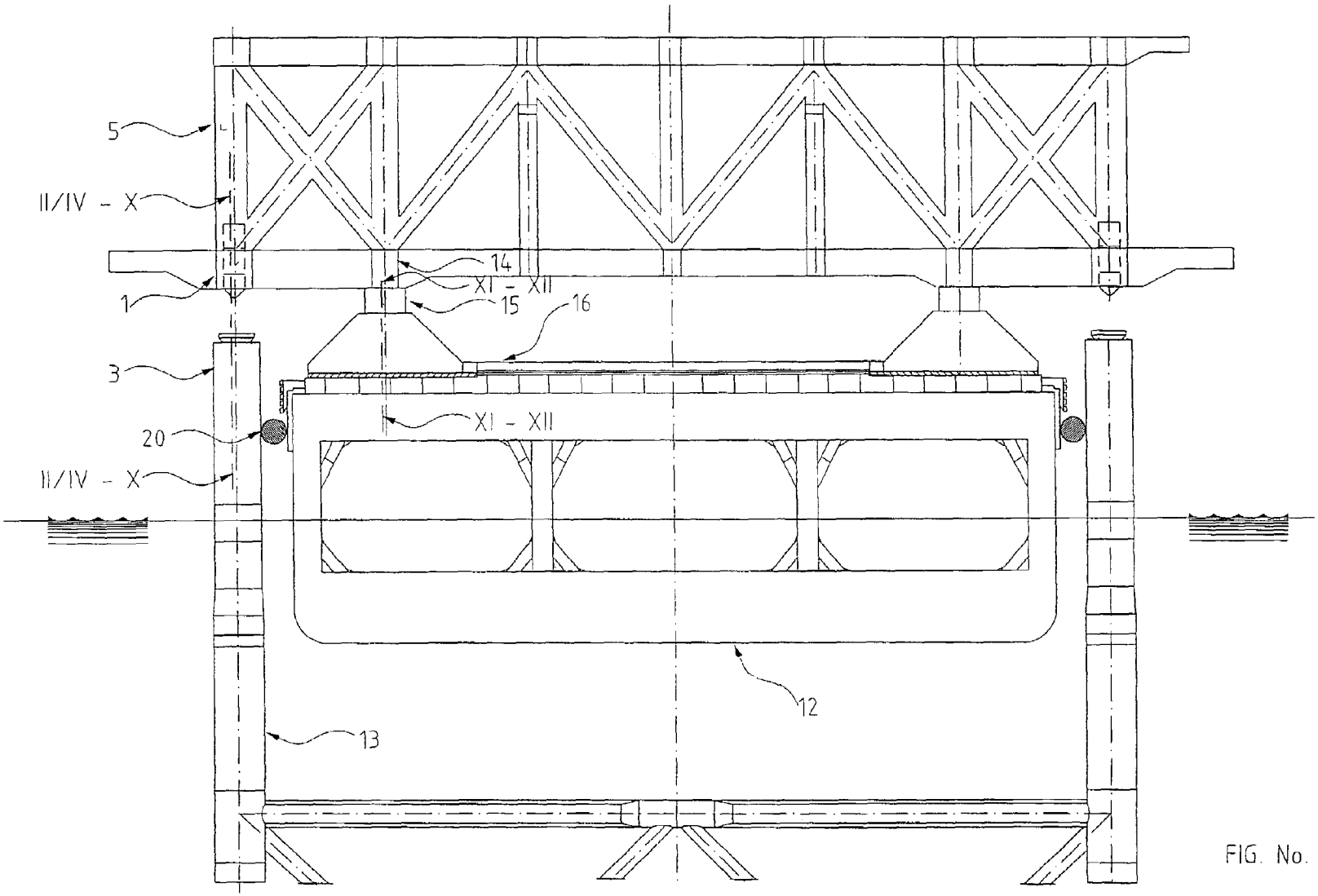
FIG. No. 1

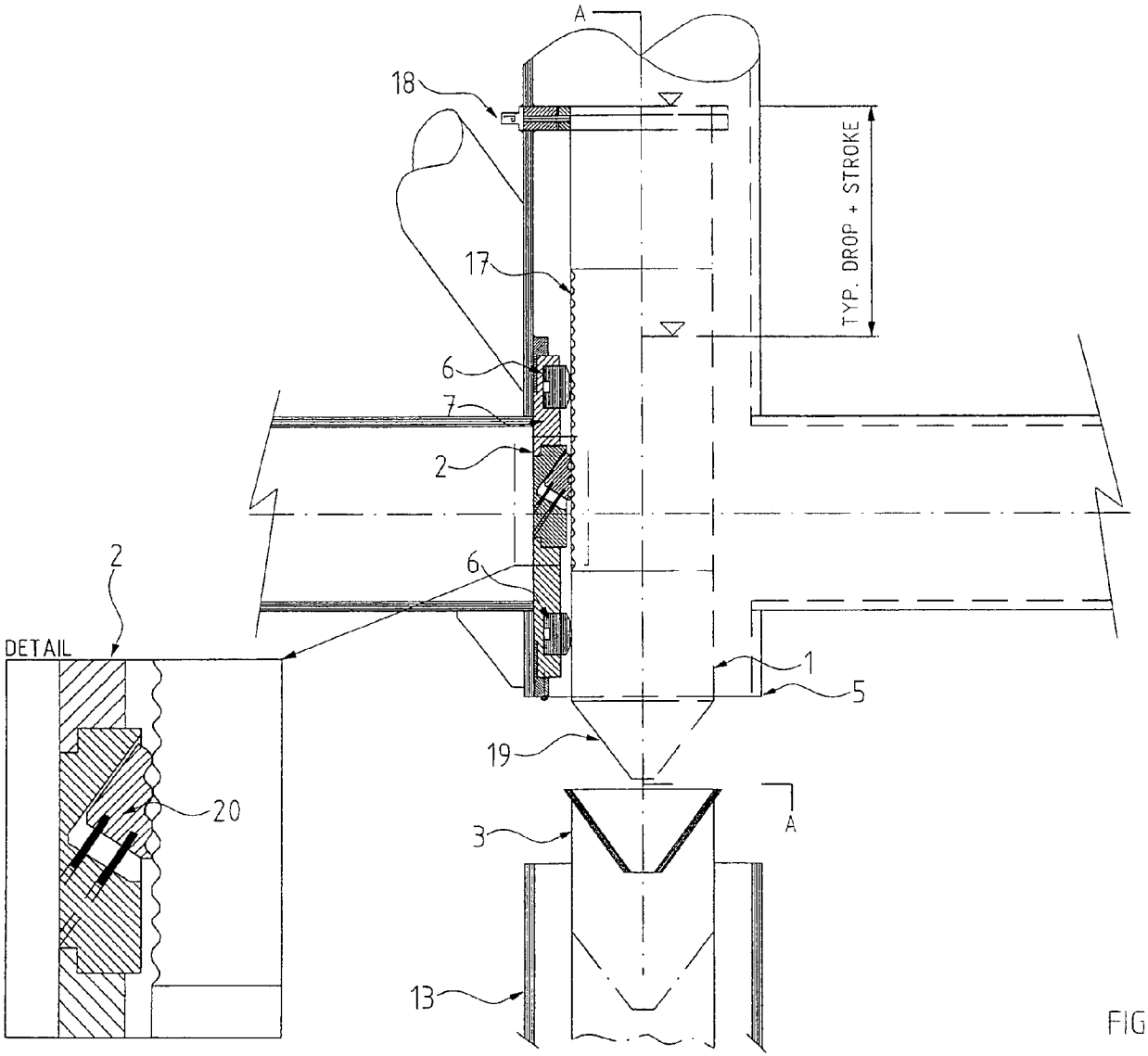
FIG. No. 2

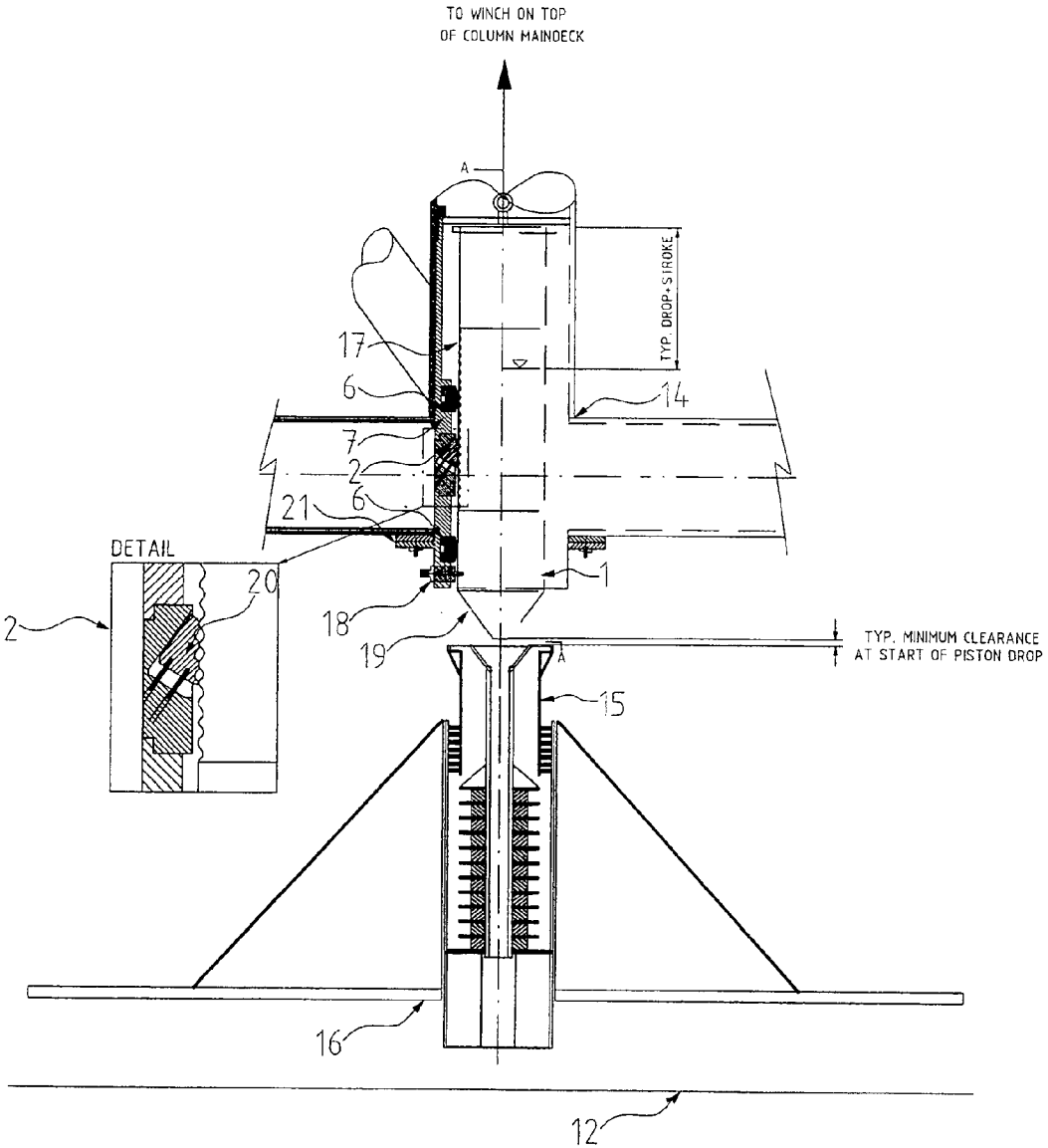
FIG. No. 3

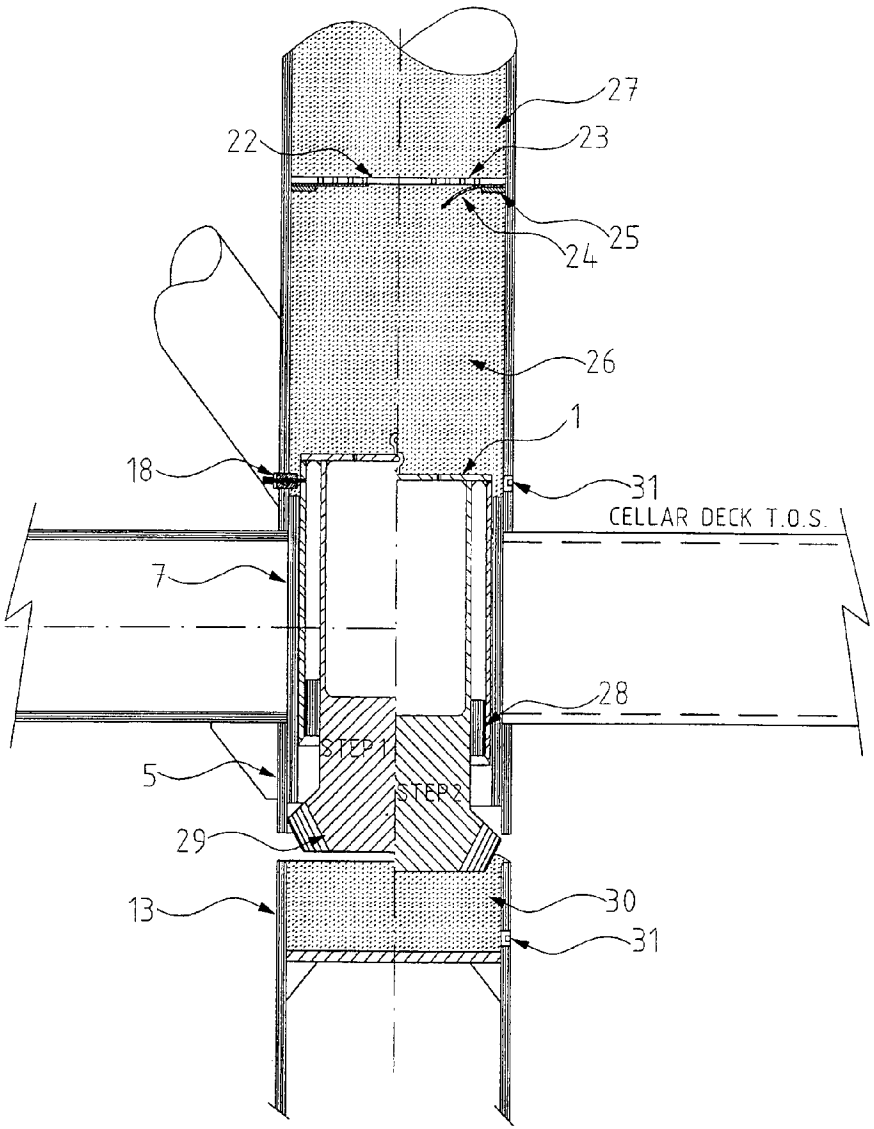
FIG. No. 4

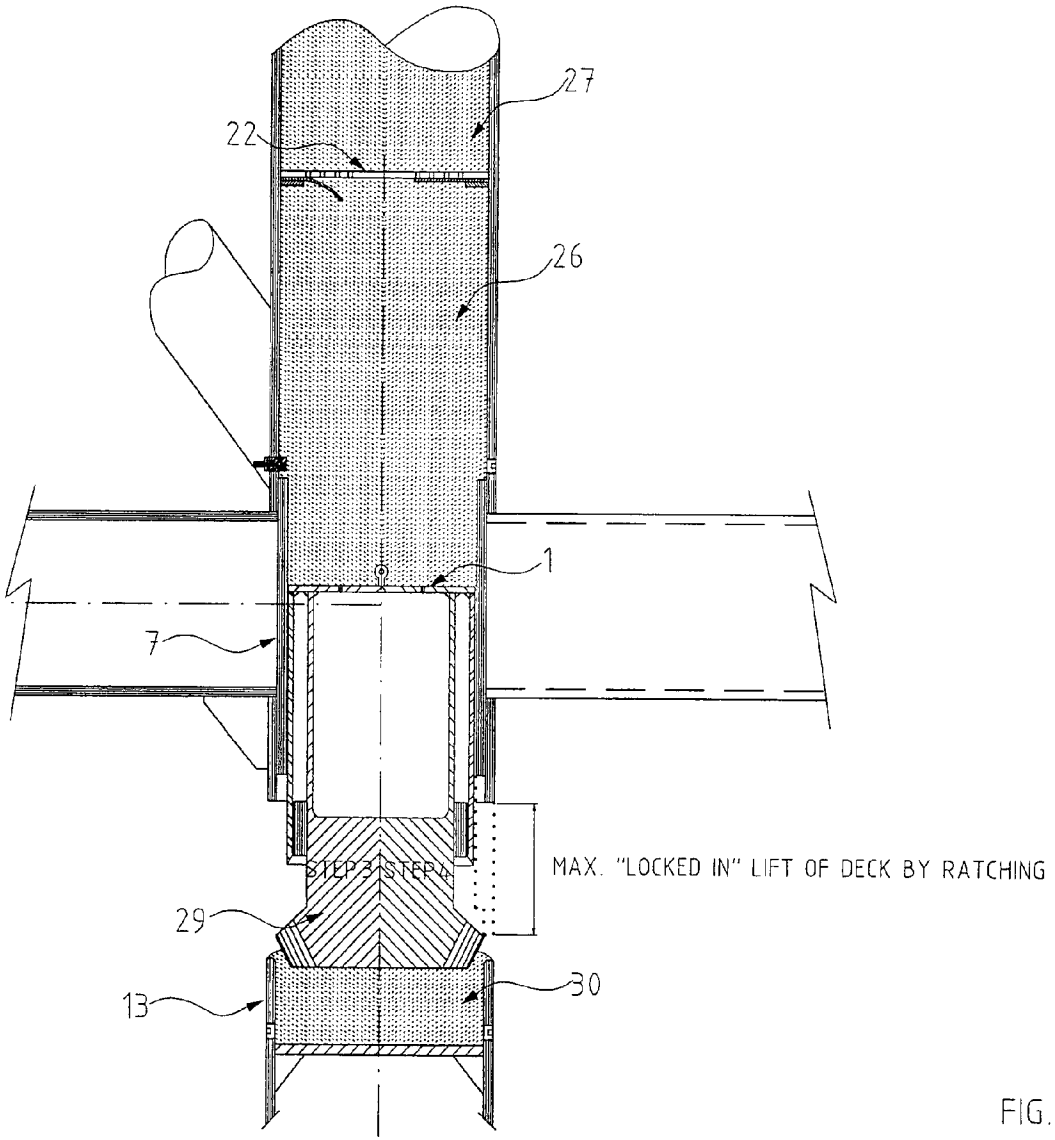
FIG. No. 5

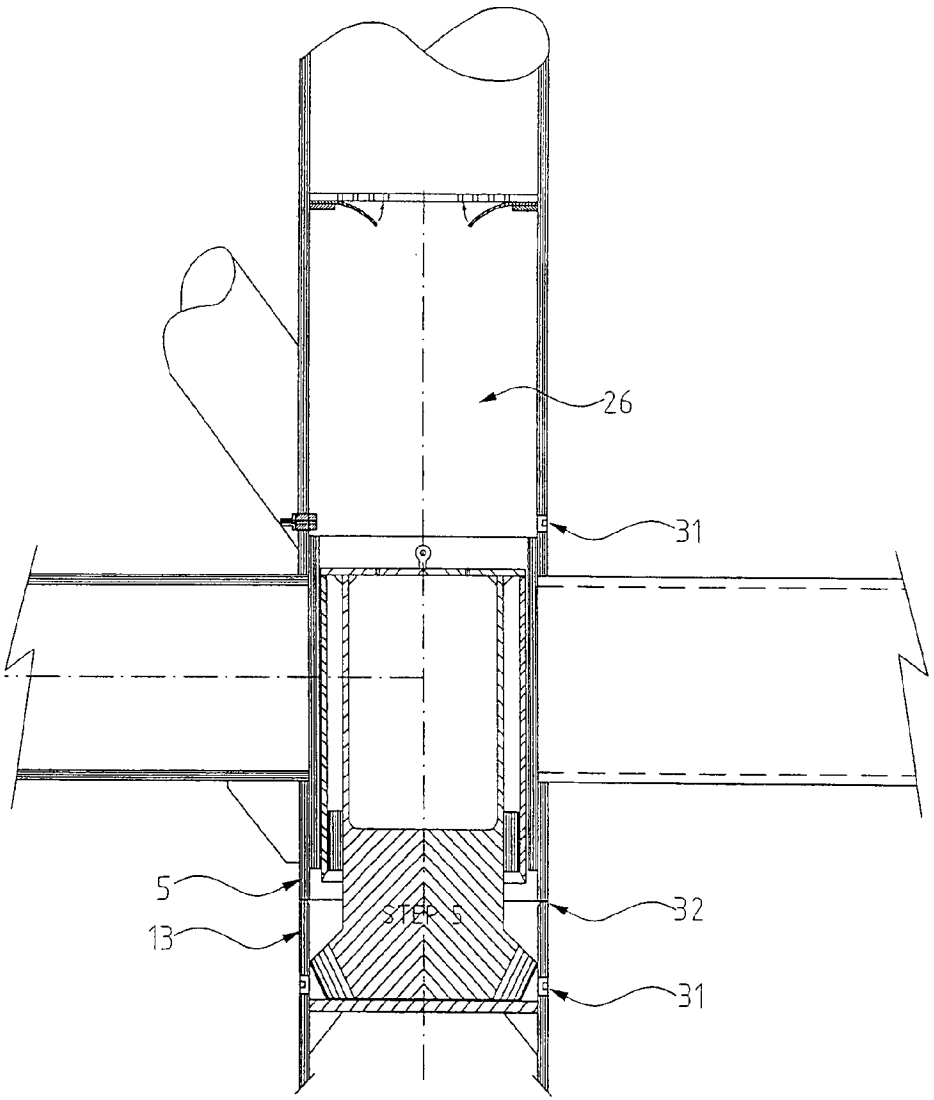
FIG. No. 6

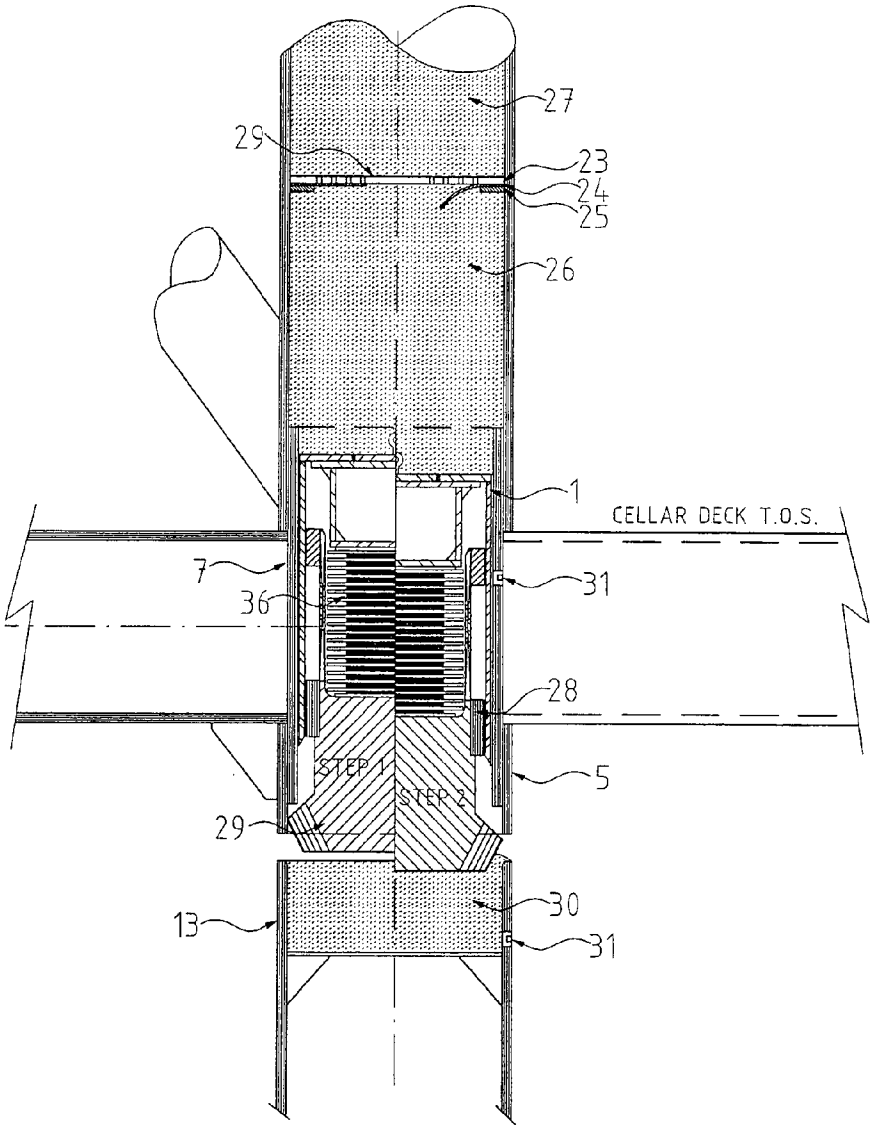
FIG. No. 7

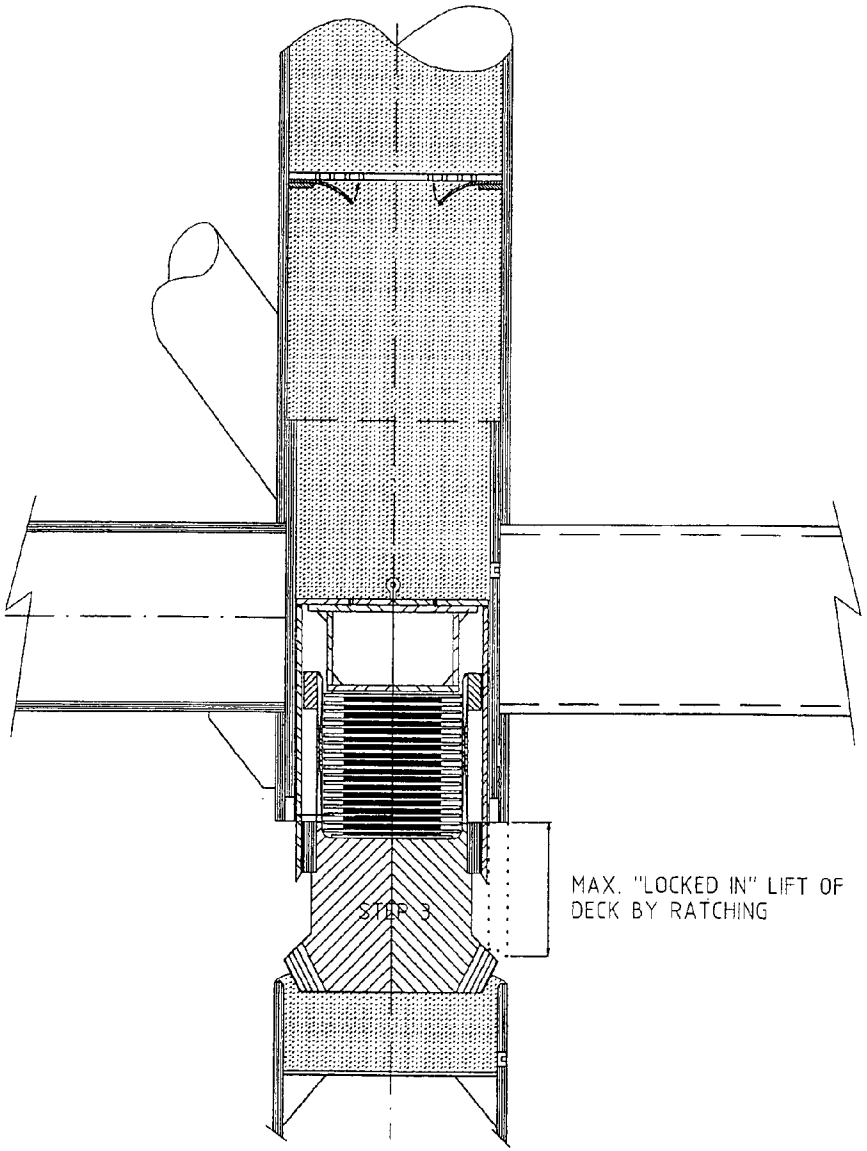
FIG. No. 8

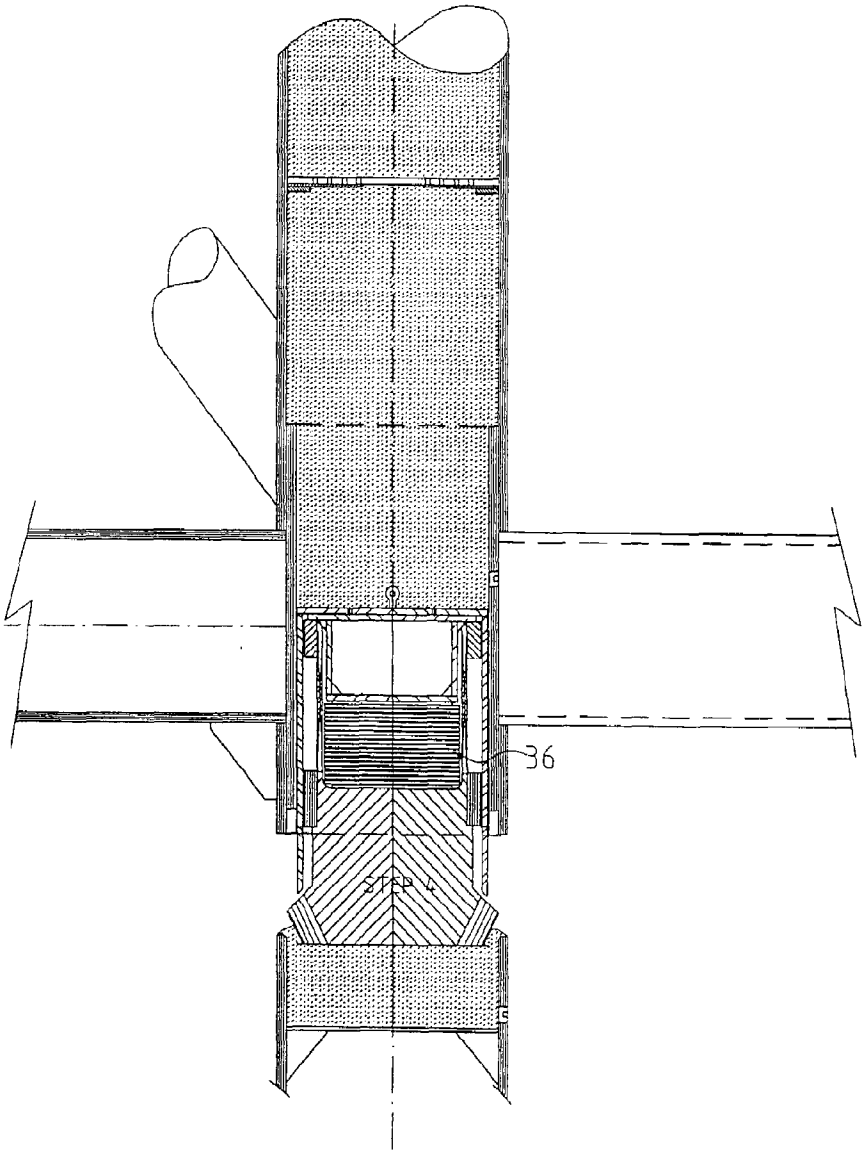
FIG. No. 9

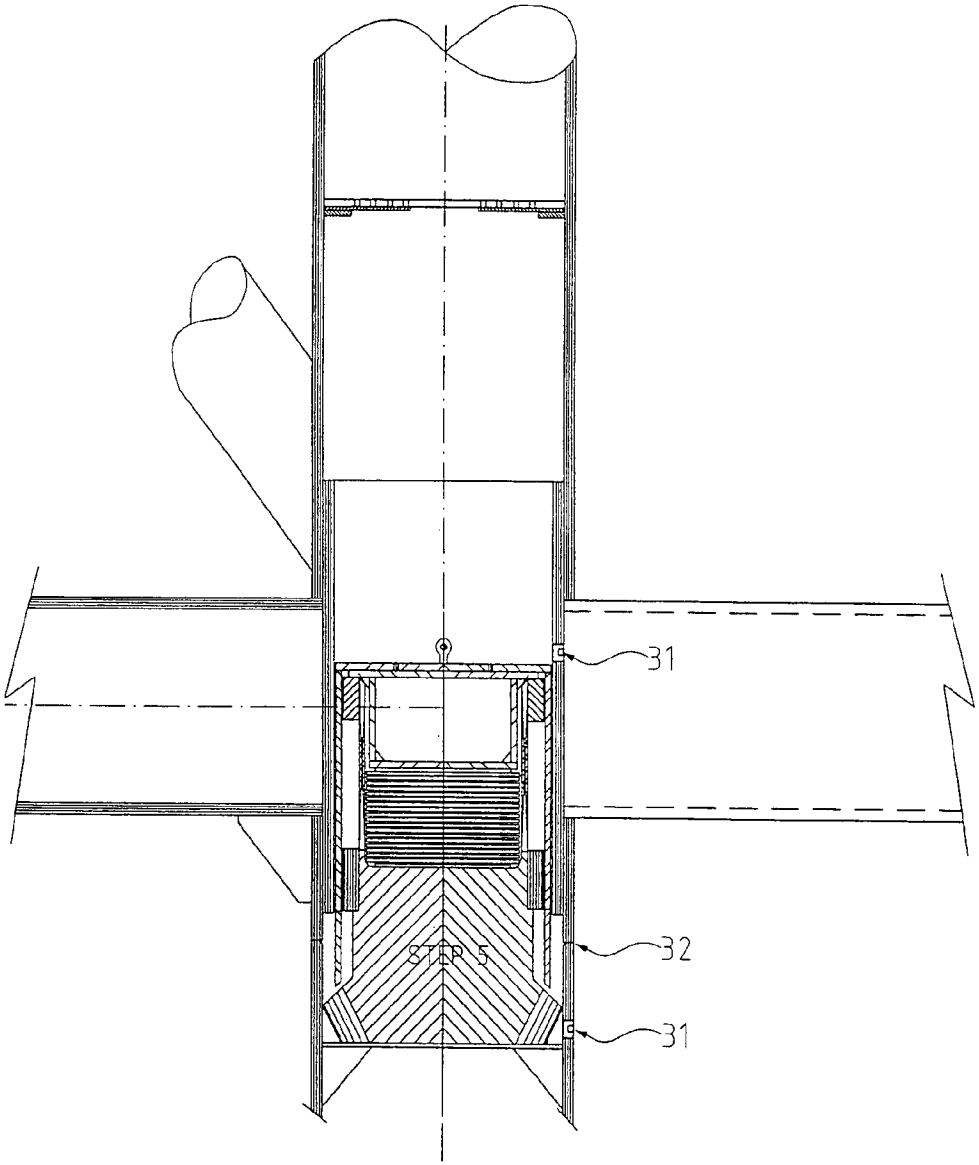
FIG. No. 10

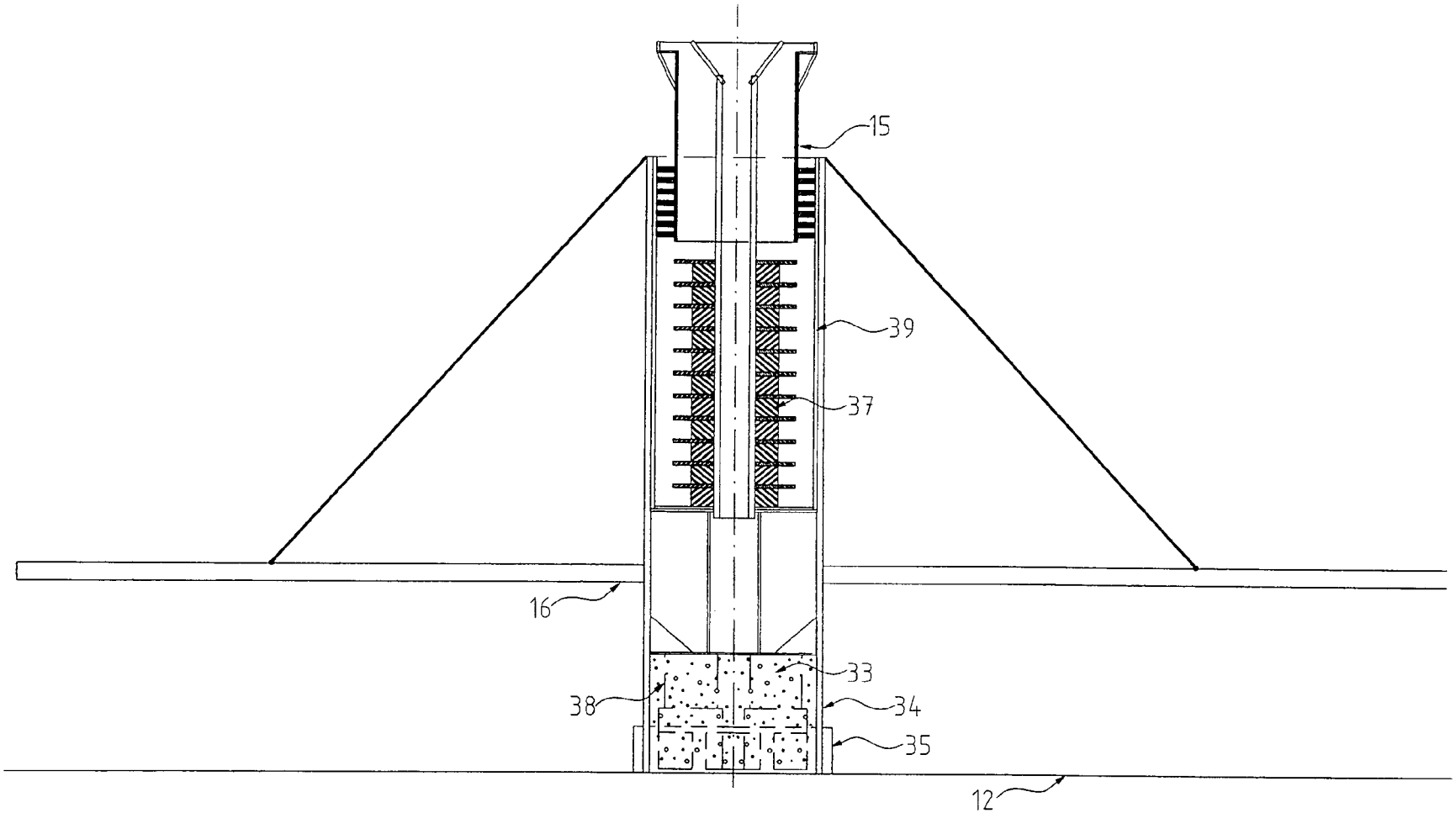
FIG. No. 11

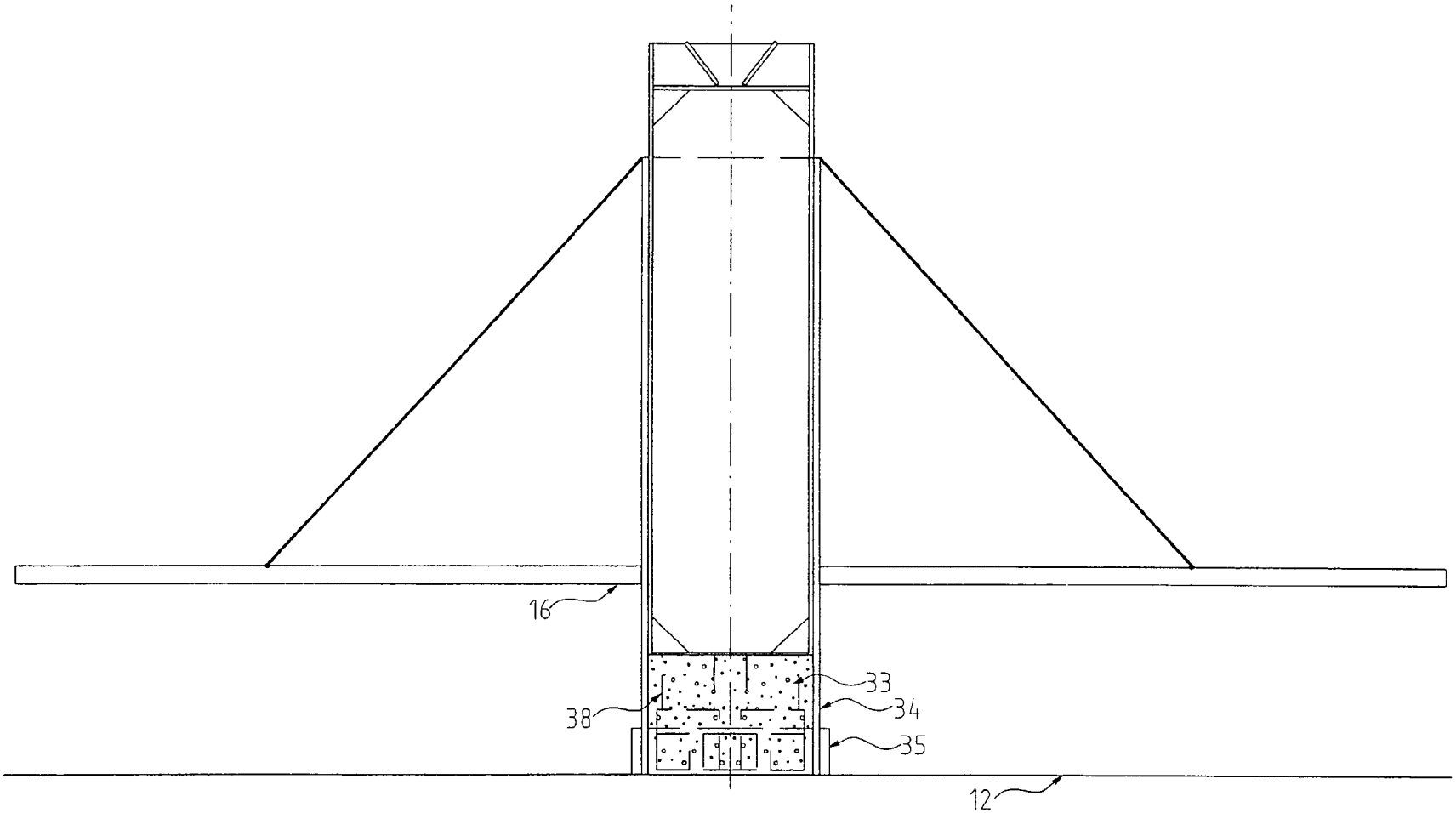
FIG. No. 12

METHOD AND ARRANGEMENT FOR INSTALLATION AND REMOVAL OF OBJECTS AT SEA

FIELD OF THE INVENTION

The present invention relates to a method for installation or removal of objects at sea, particularly relating to installation or removal of objects that are part of the infrastructure in oil and gas fields offshore.

Conventional methods are normally based on transporting a platform deck to the destination on the deck of an installation vessel or a transportation barge, with subsequent offshore lift from barge deck onto the platform-deck carrying structure (jacket or substructure). Such operations set high demands to crane capacity and deck space and can be very weather sensitive operations and are tying up costly construction vessels for long periods of time.

This has led to the introduction of the principle of "barge floatover" for the installation where the barge transporting the platform deck has large capacity ballasting system.

At the site the jacket substructure will have been pre-installed. On arrival at site the barge will be prepared for the deck installation. On a favourable weather forecast and acceptable environmental conditions the barge with the deck will be docked and positioned inside the jacket substructure. The barge will thereafter be ballasted to transfer the deck load through shock-absorbing cells normally called Leg Mating Units (LMU) into the jacket legs. The barge will then continue ballasting until the barge deck clears the underside of the deck structure, after which the barge will be withdrawn from the structure and the two structures can be welded together.

The same but inverted principle called "barge float-under" can be used when a platform deck is to be removed from a jacket substructure. The ballasted barge will be docked and positioned under the platform deck and inside the jacket substructure. In advance the platform deck and substructure has been prepared for the "lift off operation" by cutting and securing the structural legs between the jacket structure and deck structure at the appropriate level. The barge will thereafter be deballasted to transfer the deck load through shock-absorbing cells called Deck Supporting Units (DSU) onto the barge deck. The deballasting will continue until the the deck legs clear the jacket legs, after which the barge with the platform deck will be withdrawn.

Normally, as mentioned above, to reduce the impact loads arising from wave induced motion of the barge, two types of shock-absorbing installation aids, LMU and DSU, are foreseen required consisting of spring supports, rubber or elastomeric design giving restrains in the vertical and lateral directions. For a barge "float-over" or "float-under" (removal) operation:

- Leg mating units (LMU) are normally located on the top of the jacket legs, and are aimed at reducing the impact loads between deck stabbing cones and jacket legs during the various stages of the installation and load transfer.
- Deck support units (DSU) are installed in the deck support structures of the barge, in order to reduce any impact loads between vessel and deck underside arising during and after load transfer while the barge is being ballasted down and separates from the deck.

Oil and gas field developments are experiencing a push towards more remote areas with less infrastructure and tougher environments that are increasing the needs for more efficient methods for installation or removal of objects. Also, with an increasing number of oil and gas fields being decommissioned, there is a growing need for removal of objects. More of the objects that are to be installed or removed from the offshore sites are of large dimensions and weights, typically 60×60 m wide and weighing 15,000 tons. Based on these aspects there is a need to develop new and alternative methods for installation/removal of objects, as conventional methods become unfit or inadequate.

A method according to the preamble of claim 1 is known from U.S. Pat. No. 5,522,680. In this method the jack mechanism in each deck leg is a large hydraulic cylinder device which requires a very substantial hydraulic system in order to function properly. The hydraulic cylinders and their system are complicated and very expensive equipment and require a reliable power supply and operator attention in order to function as intended.

The object of the present invention is to alleviate the drawbacks and deficiencies mentioned above and particularly to obtain a method and arrangement by which the deck transfer can be accomplished in a fairly simple and substantially automatic manner by means of equipment that is reliable, generally self-contained and relatively inexpensive.

This object is attained by a method and an arrangement as defined in the claims.

When applying the invention one achieves several advantages compared to above mentioned conventional methods. Advantages to be mentioned in particular are that, with the use of a rather simple mechanical system, one can reduce the period to a minimum where the structures and barge deck are exposed to great shock loads during the load transfer caused by wave motion. Thereby one is reducing the risk for failures in a very sensitive phase of this offshore operation. Also, the requirements and strain normally put onto the very expensive shock cells can be alleviated as the invention is reducing the possibilities for structural separation or "lift off" once contact has been made between the two structures.

The installation and removal method is summarised as follows:

When a barge with a platform deck has been positioned between the jacket legs ready to start transferring the load of the deck onto the jacket legs called a "deck float-over" type of operation, a ratchet jack type of mechanism situated in the lower part of the deck legs are brought into contact with the jacket legs or via the leg mating units (LMU) on the top of the jacket legs. Instantly, depending on the barge and deck wave induced vertical motion, the mechanism starts working. Each time the barge and deck is moving upwards on a wave, the mechanism will let the deck move freely upwards but at the same time keeping contact with the top of the jacket legs. When the barge movement starts turning downwards on the crest, the mechanism will lock the deck in its position relative to the jacket leg and the deck load is started being transferred from the barge onto the jacket. In this way one avoids "lift off" or separation of the structures and thereby also reduces the great dynamic shocks into these and into the barge. Subsequent wave induced motions with larger amplitudes than the earlier waves will thus very soon lift the deck up further relative to the barge deck and unload the barge. The major and most weather sensitive part of the load transfer is thus done more quickly and completion of the balancing part of the load transfer with the final ballasting can start earlier and the whole operation including undocking of barge completed in less time and more safely than with more conventional methods.

The need and requirements for the leg mating units on top of the jacket legs have to be addressed on a project to project basis depending on the type of ratchet mechanism chosen but some degree of lateral restrains will always be required during the initial load transfer in order to make up for misalignment and tolerances between the legs. Likewise, the need for deck support units on the barge with vertical and lateral restrains and shock absorbing mechanism has to be addressed on a project to project basis depending on the type of ratchet-mechanism chosen.

The same but inverted principle called "barge float-under" can be used when a platform deck is to be removed from a jacket substructure. When a ballasted barge has been positioned between the jacket legs under a platform deck ready to start transferring the load of the deck onto the barge, the ratchet jack type of mechanism now situated in the lower part of the deck nodes above the barge deck are brought into contact with the deck support structure on the barge deck or via deck support units (DSU). Instantly, depending on the barge and its wave-induced vertical motion, the mechanism starts working. Each time the barge is moving downwards on a wave, the mechanism is following the barge down and thus keeping contact with the top of the deck support structure on the barge or via a DSU on the same structure. When the barge is starting the upward movement from a wave-trough, the ratchet type of mechanism will lock the platform deck in its position relative to the barge deck and the deck load is started being transferred from the jacket onto the barge. In this way one avoids "lift off" or separation of the deck structure relative to the barge and thereby also reduces the great dynamic shocks into platform deck and barge. Subsequent wave-induced motions with larger amplitudes than the earlier waves will very soon lift the platform deck further up relative to the barge deck and continue transferring load onto the barge. The major and most weather-sensitive part of the load transfer is thus done more quickly, and completion of the balancing part of the load transfer with the final deballasting can start earlier and the whole operation including undocking of barge completed more safely and in less time than with more conventional methods. The need for deck support units with vertical and lateral restrains and shock absorbing mechanism consisting of spring supports, rubber or elastomeric design has to be considered on a project to project basis.

BRIEF DESCRIPTION OF THE DRAWINGS

The present invention shall be described in the following with reference to the attached drawings which illustrate a preferred embodiment, wherein:

FIG. 1 is a transverse section of barge and a platform deck in a typical float-over operation scenario ready to start the transfer operations of the deck load onto a jacket structure. A view of a typical float-under operation scenario for deck removal will be similar but there will be no LMU situated in the jacket and the ratchet jack type of mechanism will be located in the deck nodes above the deck support structure located on the barge deck.

FIG. 2 is a section of the lower part of the deck leg in FIG. 1 showing a ratchet jack type of mechanism called ratchet jack ready to be dropped into contact directly with the jacket leg or alternatively via a LMU as shown in the top of a jacket leg in a float-over operation scenario.

FIG. 3 is a section showing the ratchet jack type of mechanism called ratchet jack applied in a float-under (removal) operation scenario. The ratchet jack is here located in the lower part of a deck node ready to be dropped directly into contact with deck support structure on the barge deck or alternatively via a DSU as shown on the same structure for starting the load transfer.

FIGS. 4–6 are sections of the lower part of a deck leg in FIG. 1 showing the five main operational working steps of a ratchet jack type of mechanism called sand trap ratchet jack in a float-over operation scenario shown without any LMU in the jacket leg. A view of a typical float-under (removal) operation scenario will be similar but the sand trap ratchet jack will be located in the deck nodes above the deck support structure on the barge deck similar as shown on FIG. 3.

FIGS. 7–10 are sections of the lower part of a deck leg in FIG. 1 showing the five main operational working steps of a ratchet jack type of mechanism called sand trap ratchet jack located in a float over operation scenario with the vertical and lateral shock absorbing functions shown integrated in the sand trap ratchet jack mechanism. A view of a typical float-under (removal) operation scenario will be similar but the sand trap ratchet jack will be located in the deck nodes above the deck support structure on the barge deck similar as shown on FIG. 3.

FIGS. 11–12 are sections of DSU and deck support structure stool located on the barge deck underneath the platform deck in a float-over operation scenario as indicated in FIG. 1 showing means for rapid withdrawal after load transfer has been accomplished to avoid shock impact in the period after transfer. Alternatively, this can also be achieved by hydraulic means as indicated.

DETAILED DESCRIPTION OF THE PREFERRED EMBODIMENT

FIG. 1 shows a platform deck object on a barge 12 in a typical float-over operation scenario with sway motions limited by inflated fenders 20 and surge motions by fore and aft mooring lines (not shown) ready to start the transfer operation of the deck load onto the legs 13 of the jacket structure with the piston jack 1 of the invention situated in the deck leg 5 and the shock-absorbing mechanism LMU 3 disposed in the top of the jacket legs 13. A typical float-under operation for deck removal will be of a similar arrangement, but the piston jack 1 of the invention will now be located in the deck nodes 14 above the deck support unit with the shock absorbing mechanism DSU 15 on the barge deck with its support structure 16.

FIG. 2 shows a preferred embodiment of the present part of the invention called ratchet jack applied in a float-over operation scenario. The piston jack 1 constitutes a part of the piston jack assembly 7 inserted in the deck leg 5 and the piston jack is free to move inside this assembly which is also fitted with lateral supports 6. The lower part of the piston jack is designed as a cone. The cone shall assist guiding the deck leg 5 onto the jacket leg 13 and into a leg mating unit 3 located in the top part of the jacket leg having a receptacle fitting the cone. The piston jack assembly 7 is fitted with a ratchet 2 consisting of a number of spring loaded pawls or arrestors 20 located around the threaded section 17 of the piston jack 1, enabling the jack to move freely downwards relatively whenever it has no load and to be locked to take on load whenever it is starting on an relative upward movement.

The piston jack 1 is shown in the pre-dropped position ready to be dropped onto the jacket leg 13 by a release mechanism 18 consisting of a number of hydraulic operated pins penetrating the top of the piston jack 1. When the actual load transfer operation is to be started, the piston jack 1 is released and, through operation of the ratchet 2, is allowing the piston jack 1 to drop down inside the assembly 7 hitting the top of the jacket leg 13. When the barge is lifted upwards in the wave, the piston jack assembly 7 is allowing contact to be maintained between the piston jack cone 19 and the LMU 3 in the top of the jacket leg 13 by letting the ratchet 2 further operate freely. When reaching the maximum uplift on the wave, no load transfer has yet taken place.

When the platform deck and barge are just passing the wave crest, the ratchet 2 will lock onto the threaded section 17 of the piston jack 1, thus starting to transfer load through the ratchet 2, piston jack 1, piston jack cone 19 and onto jacket leg 13 via the LMU 3 located in the top of the jacket leg. On the subsequent waves with amplitudes larger than the earlier waves very soon deck load will continue to be transferred and accumulated onto the jacket leg 13 and a point reached where the wave lift of the deck has arrived at a maximum and been locked in by the ratchet jack. The balance of load will then be transferred through the ballasting operation or, alternatively, by a combined operation of ballasting and rapid retrieval of the DSU or deck support stool by drainage of a sand-cushion underneath as shown in FIGS. 11 and 12 or, alternatively, by hydraulic means of lowering.

FIG. 3 shows a preferred embodiment of the present part of the invention called ratchet jack being of a similar type as shown in FIG. 2 but applied in a float-under (removal) operation scenario. The piston jack 1 constitutes a part of the piston jack assembly 7 inserted in the deck node 14 and fastened to this node by typically a number of hydraulic wedges 21 on the flange of the assembly 7, and the jack is free to move inside this assembly, which is also fitted with lateral supports 6. The lower part of the piston jack is designed as a cone 19. The cone shall assist guiding the deck node 14 onto the DSU 15 located on the deck support structure 16 on barge deck and having a receptacle fitting the cone. The piston jack assembly 7 is fitted with a ratchet 2 consisting of a number of spring loaded pawls or arrestors 20 located around the threaded section 17 of the piston jack 1, enabling the jack to move freely downwards relatively whenever it has no load and to be locked to take on load whenever it is starting on an upward relative movement.

The piston jack 1 is shown in the pre-dropped position ready to be dropped onto the DSU 15 on the barge deck by a release mechanism 18 consisting of a number of hydraulic operated pins penetrating the bottom part of the piston jack 1. When the actual load transfer operation is to be started, the piston jack 1 is released and through operation of the ratchet 2 is allowing the piston jack 1 to drop down inside the assembly 7, hitting the top of the receptacle in the DSU 15. When the barge is moving downwards in the wave, the piston jack assembly 7 is allowing contact to be maintained between the piston jack cone 19 and the top of the DSU 15 by letting the ratchet 2 further operate freely. When reaching the trough of the wave, no load transfer has yet taken place.

When the barge is just passing the trough of the wave, the ratchet 2 will lock onto the threaded section 17 of the piston jack 1 starting to transfer deck load through the ratchet 2, piston jack 1, piston jack cone 19 and onto the DSU 15 on the deck support structure 16 on barge deck. Upon subsequent waves with amplitudes larger than the earlier waves, very soon deck load will continue to be transferred from the jacket and accumulated onto the barge and a point reached where the wave lift of the deck has arrived at a maximum and has been locked in by the ratchet jack. The balance of load will be transferred through a deballasting operation.

FIG. 4 shows a preferred embodiment of the present part of the invention called sand trap type of ratchet jack wherein the piston jack denoted 1 is shown in the first of two working steps in a float-over type of operation scenario. The piston jack constitutes a part of a jack assembly 7 inserted and fastened internally in the deck leg and is free to move inside this assembly and is also fitted with lateral shock absorbers 28. The shock absorbers can be of an elastomeric design as indicated here or can be of a rubber or spring type design. The lower part of the pistonjack is designed as a cone 29, which also can be fitted with elastomeric as shown in the figure. The cone shall assist in guiding the deck leg 5 onto the jacket leg 13. Above the piston jack in the deck leg is shown a sand cushion 26 consisting of sand with high quality homogenized equal sized particles. A sand cushion 30 can also be introduced in the jacket leg 13 below the piston jack 1 as indicated in the figure as an alternative to have a LMU in the jacket leg. Above the sand cushion in the deck leg 26 is shown the sand trap 22 enabling the mechanism to work as a ratchet jack type of mechanism. The sand trap consists of the perforated bottom plate 23 located in the sand storage 27 situated above the sand cushion 26 in the deck leg 5 and is underneath covered with a flapper ring 24 of flexible material typical rubber kept in place with a bolted steel retainer ring 25 beneath the perforated bottom plate 23. This arrangement is allowing the piston jack 1 to move freely downwards relatively whenever it has no load and to be locked to take on load whenever it is starting on an upward relative movement as subsequently described.

The piston jack 1 is in step 1 shown in the pre-dropped position ready to be dropped onto the jacket leg 13 by a release mechanism release 18 consisting of a number of hydraulic operated pins penetrating the top part of the piston jack 1. In this position the sand cushion 26 and sand-storage 27 is filled up completely with sand. When the actual load transfer operation is wanted to be started the piston jack assembly 7 is allowing the piston jack 1, released by the operating the release mechanism 18, to drop down hitting the top of the jacket leg 13 as shown in step 2. The increased volume of the sand cushion space 26 in the deck leg 5 will now establish a differential sand pressure across the flapper ring 24 in the sand trap 22 forcing the ring to bend downwards uncovering the perforations in the bottom plate 23 and allowing sand to pass through the sand trap 22 from the storage 27 and fill up the void space in the sand cushion 26 of the deck leg column 5.

FIG. 5 is in step 3 showing the mechanism when the barge and platform deck is lifted upwards on a wave. The piston jack assembly is allowing contact to be maintained between the piston jack cone and the top of the jacket leg. During this vertical movement of the deck the differential sandpressure across the sand trap will cause the sand to flow downwards and the void space in the sand cushion in the deck leg to be filled up with sand from the storage. When reaching the maximum uplift on the wave in step 3, the sand cushion will have been filled up but no load transfer has yet taken place.

Step 4 is showing the mechanism when platform deck and barge is just passing the wave crest with the sand trap in closed position and sand cushion compressed starting to transfer load through the trapped sand cushion column, piston jack, piston jack cone and onto jacket leg with a possible sand cushion in the top of the jacket leg. Upon the subsequent waves with larger amplitudes than the earlier waves, very soon deck load will be further transferred and accumulated onto the jacket leg until a point reached where the wave lift of the deck has arrived at a maximum and been locked in by the sand trap ratchet. The balance of load will then be transferred through the ballasting operation or, alternatively, by a combined operation of ballasting and rapid retrieval of the DSU 15 or deck support stool 32 on the barge by drainage of a sand cushion underneath, as indicated in FIGS. 11 and 12 or, alternatively, lowering by hydraulic means.

FIG. 6 is showing the position of the platform deck relative to the jacket leg after former has been lowered by draining the sand out from the sand cushions by opening the sand plug 31 in the deck leg 5 and jacket leg 13, enabling the structures to come into contact and be welded together at the interface point 32.

FIG. 7 shows a preferred embodiment of the present part of the invention called sand trap type of ratchet jack and is shown in the first two working steps in a float-over type of operation scenario. The piston jack 1 constitutes a part of the piston jack assembly 7 and is inserted and fastened internally in the deck leg 5 and is free to move inside this assembly and is also fitted with lateral and vertical shock absorbers and restraints, item 28 and 36. The shock absorbers can be of an elastomeric design as indicated here or can be of a rubber or spring type design. The lower part of the piston jack is designed as a cone 29, which also can be fitted with elastomeric as shown in the figure to absorb lateral shock loads. The cone shall assist guiding the deck leg 5 onto the jacket leg 13. Above the piston jack in the deck leg is shown a sand cushion 26 consisting of sand with high quality homogenized equal sized particle. Sand cushion 30 can also be introduced in the jacket leg 13 below the piston jack as indicated in the figure.

Above the sand cushion in the deck leg is shown the sand trap 22, enabling the mechanism to work as a ratchet jack type of mechanism. The sand trap consists of the perforated bottom plate of the sand storage 23 located above the sand cushion 26 in the deck leg and is covered underneath with a flapper ring 24 of flexible material, typical rubber, kept in place with a bolted steel retainer ring 25 beneath the perforated bottom plate. This arrangement is allowing the piston jack 1 to move freely downwards relatively whenever it has no load and to be locked to take on load whenever it is starting on an upward relative movement.

The piston jack 1 is in step 1 shown in the pre-dropped position ready to be dropped onto the jacket leg 13 by a release mechanism of a similar type as shown in item 18 of FIG. 4. In this position the sand cushion 26 and sand storage 27 is filled up completely with sand. When the actual load transfer operation is to be started, the piston jack 1 is released by the release mechanism, allowing the piston jack to be dropped down hitting the top of the jacket leg 13 as shown in step 2. The increased volume of the sand cushion space 26 in the deck leg 5 will now establish a differential sand pressure across the flapper ring 24 in the sand trap 22, forcing the ring to bend downwards, uncovering the perforations in the bottom plate and allowing sand to pass through the sand trap 22 from the storage 27 and fill up the void space in the sand cushion 26.

FIG. 8 is in step 3 showing the mechanism when the barge and platform deck is being lifted upwards on a wave. The piston jack assembly is allowing contact to be maintained between the piston jack cone and the top of the jacket leg. During this vertical movement of the deck the differential sand pressure across the sand trap will cause the sand to start flowing downwards and the void space in the sand cushion in the deck leg to be filled up with sand from the storage. When reaching the maximum uplift on the wave, the sand cushion will have been filled up but no load transfer has yet taken place.

In FIG. 9 step 4 is showing the mechanism when the platform deck and barge is just passing the wave crest with the sand trap in closed position and sand cushion compressed, starting to transfer load through the trapped sand cushion column, piston jack with the vertical and lateral shock absorbing elements activated and compressed, piston jack cone with lateral shock absorbing elements activated and onto jacket leg, with possible sand cushion in the top of the jacket leg. Upon subsequent waves with larger amplitudes than the earlier waves, very soon deck load will be further transferred and accumulated onto the jacket leg until a point reached where the wave lift of the deck has arrived at a maximum and the deck has been locked in by the sand trap ratchet. The balance of load will be transferred through the ballasting operation, or alternatively, by a combined operation of ballasting and rapid retrieval of the DSU 15 or deck support stool 32 on the barge by drainage of a sand cushion underneath, as indicated in FIGS. 11 and 12 or, alternatively, lowering by hydraulic means.

FIG. 10 is showing the position of the platform deck relative to the jacket leg after the former has been lowered by draining the sand out from the sand cushions in the deck leg and jacket leg by opening the sand plug 31, enabling the structures to come into contact and be welded together at the jacket and deck interface 32.

FIG. 11 is showing a sand cushion 33 in cylinder 34 located underneath the DSU 15 with its cylinder 39 which is free to move inside the cylinder 34 and standing on the deck of the barge 12. When load transfer to jacket has been accomplished, rapid withdrawal of DSU 15 onto the deck support structure 16 to avoid impact loads can be done by rotating cylinder ring 35, allowing ports in the base of cylinder 34 and in ring 35 to coincide, causing sand to be drained out from the sand cushion 33 underneath the DSU 15 and the DSU to be lowered down quickly. The same can also be accomplished by hydraulic means by replacing sand cushion 33 with hydraulic jacks, as indicated by item 38.

FIG. 12 is showing a sand cushion 33 in cylinder 34 located underneath the deck support structure stool 32 which is free to move inside the cylinder 34. When load transfer to jacket has been accomplished, rapid withdrawal of stool 34 to avoid impact loads can be done by rotating cylinder ring 35, allowing ports in the base of cylinder 34 and in ring 35 to coincide causing sand to be drained out from the sand cushion 33 underneath the stool and the stool to be lowered down quickly. The same can also be accomplished by hydraulic means by replacing sand cushion 33 with hydraulic jacks as indicated by item 38.

The invention is not limited to the exemplifying embodiments described above, but may be varied and modified within the scope of the appended claims. Thus, this application of the principles of "barge float-over/under" as described above may not be limited to only installation of a deck onto a jacket or substructure standing on sea bottom, as the principle of load transfer by the jack type of mechanism will also be working in the same manner as described having a transfer of the deck onto or from a floating substructure with one or more legs or columns in lieu of transfer onto or from a substructure resting on sea bottom.

Likewise, the deck transportation unit may not be limited to a single barge, as the principle of load transfer by the jack type of mechanism will also be working having the deck located on a catamaran type of vessel or even having the deck resting on two separate barges or pontoons during the transfer of the deck load.

We claim:

1. A method for installation of a deck structure at an offshore location, where the deck structure is put on a vessel at a location inshore, then transported on the vessel to the offshore location and positioned relative to legs (13) of a jacket or gravity base type support structure standing on the sea bottom, or the legs or columns of a floating substructure, the deck structure having deck legs (5) corresponding to support legs (13) on the support structure, the deck legs (5) each being provided with a jack type of mechanism with an associated piston (1) which is extended into contact with and supported by the top part (3) of the corresponding support leg (13) at the beginning of a procedure for transferring the weight of the deck structure from the vessel to the support legs (13), said procedure comprising ballasting the vessel (12) while permitting wave induced motions of the vessel (12) to further lift the deck structure with respect to the support structure and permitting the pistons (1) to extend further below the respective deck legs (5) when a higher wave is encountered, but preventing the pistons (1) from moving into the respective deck legs (5) upon receding wave motion, continuing ballasting at least until the entire weight of the deck structure has been transferred to the support structure in order for the vessel (12) to clear the deck structure and permit removal of the vessel (12) with respect to the support legs (13), and lowering the deck structure to bring the deck legs (5) and the corresponding support legs (13) together to permit welding of the deck structure and support structure together, wherein the pistons (1) are prevented from moving into the respective deck legs (5) during the weight transfer by mechanically locking the pistons (1) in the legs by means of a one-way ratchet type mechanism.

2. A method according to claim 1, wherein a wedge type ratchet mechanism (2,17,20) is used.

3. A method according to claim 1, characterised in that a sand trap type ratchet mechanism (22–26) is used.

4. A method according to claim 1, wherein the pistons (1) include at least one shock absorber (28,29,36).

5. A method according to any one of the preceding claims, wherein, in order for the vessel (12) to clear the deck structure quickly upon completed weight transfer, vertically movable supports (15) between the vessel (12) and deck structure are lowered rapidly by draining sand (33) from underneath the respective supports (15).

6. A method according to any one of the preceding claims 1, 3 or 4, wherein, when bringing the deck structure and the support structure together, the pistons (1) are permitted to controllably recede into the deck leg (6) and/or support leg (13) by letting sand out of at least one sand cushion (26, 30) supporting an end of the piston (1).

7. A method for removal of a deck structure at an offshore location, where the deck structure is located on the top of a support structure having legs (13) standing on the sea bottom ready to start the removal operation by a vessel which is positioned underneath the deck structure and without interfering with the legs of the support structure, wherein the deck structure is fitted with a plurality of jack type mechanisms with an associated piston (1) located in a deck node (14) in the bottom of the deck structure, in that each of said pistons (1), while being in the ratching mode, is brought into contact with the vessel (12) directly on a deck support structure stool or, alternatively, on a deck support unit DSU (15) located on the vessel deck support structure (16), upon which and still in the ratching mode, the piston is maintaining contact with the vessel (12) through the wave induced downward motion of the vessel, thus avoiding any separation of the structures, and upon start of the subsequent upward wave induced movement of the vessel, the ratchet type mechanism with its associated piston (1) will enter a locking mode of operation, locking the deck structure in its upper position relative to the vessel, and start transferring the load quickly from the deck node (14) onto the vessel (12) with reduced shock-loads, and where subsequent wave motions with larger amplitudes than the earlier may further increase the load transfer, enabling the completion of the remaining part of the load to be transferred through subsequent deballasting and finally undocking of the vessel.

8. An arrangement for carrying out the method according to claims 1–4 or 7, comprising a piston jack assembly (7) located in the lower part of a deck leg (5) or deck node (14) of a deck structure, wherein the piston jack assembly (7) comprises a mechanical one-way ratchet jack mechanism (2).

9. An arrangement according to claim 8, wherein that the piston jack assembly (7) is fitted with a ratchet (2) consisting of a number of spring loaded wedge type pawls or arrestors (20) located around a threaded section (17) of the piston jack (1) cooperating with an upwardly converging ramp surface in said assembly (7), thus enabling the jack to move freely downwards in the assembly (7) whenever it has no load and to be locked to take on load whenever it is starting on an upward movement.

10. An arrangement according to claim 8, wherein the ratchet jack mechanism is a sand type of ratchet jack.

11. An arrangement according to claim 10, wherein the ratchet jack mechanism includes at least one shock absorber (28,29,36).

12. An arrangement according to claim 10, wherein the ratchet jack mechanism comprises a piston (1), a sand cushion (26) above the piston, and a sand trap (22) above the sand cushion (26), the sand trap (22) enabling the mechanism to work as a ratchet jack type mechanism by allowing the piston (1) and sand above it to move freely downwards whenever it has no load and to be locked to take on load whenever it is starting on an upward movement.

13. An arrangement according to claim 12, wherein the ratchet jack mechanism comprises a perforated bottom plate (23) of a sand storage (27) located above said sand cushion (26), said plate having perforations which are covered with a flapper ring (24) kept in place by a retainer (25) fixed with respect to the perforated bottom plate (23).

14. An arrangement for carrying out the method according to claim 6, comprising a piston jack assembly (7) located in the lower part of a deck leg (5) or deck node (14) of a deck structure, wherein the piston jack assembly (7) comprises a mechanical one-way ratchet jack mechanism (2).

15. An arrangement according to claim 14, wherein that the piston jack assembly (7) is fitted with a ratchet (2) consisting of a number of spring loaded wedge type pawls or arrestors (20) located around a threaded section (17) of the piston jack (1) cooperating with an upwardly converging ramp surface in said assembly (7), thus enabling the jack to move freely downwards in the assembly (7) whenever it has no load and to be locked to take on load whenever it is starting on an upward movement.

16. An arrangement according to claim 14, wherein the ratchet jack mechanism is a sand type of ratchet jack.

17. An arrangement according to claim 14, wherein the ratchet jack mechanism includes at least one shock absorber (28,29,36).

18. An arrangement according to claim 15, wherein the ratchet jack mechanism includes at least one shock absorber (28,29,36).

19. An arrangement according to claim 8, wherein the ratchet jack mechanism includes at least one shock absorber (28,29,36).

20. An arrangement according to claim 9, wherein the ratchet jack mechanism includes at least one shock absorber (28,29,36).

21. A method for installation of a deck structure at an offshore location, where the deck structure is put on a vessel at a location inshore, then transported on the vessel to the offshore location and positioned relative to legs (13) of a jacket or gravity base type support structure standing on the sea bottom, or the legs or columns of a floating substructure, the deck structure having deck legs (5) corresponding to support legs (13) on the support structure, the deck legs (5) each being provided with a jack type of mechanism with an associated piston (1) which is extended into contact with and supported by the top part (3) of the corresponding support leg (13) at the beginning of a procedure for transferring the weight of the deck structure from the vessel to the support legs (13), said procedure comprising ballasting the vessel (12) while permitting wave induced motions of the vessel (12) to further lift the deck structure with respect to the support structure and permitting the pistons (1) to extend further below the respective deck legs (5) when a higher wave is encountered, but preventing the pistons (1) from moving into the respective deck legs (5) upon receding wave motion, continuing ballasting at least until the entire weight of the deck structure has been transferred to the support structure in order for the vessel (12) to clear the deck structure and permit removal of the vessel (12) with respect to the support legs (13), and lowering the deck structure to bring the deck legs (5) and the corresponding support legs (13) together to permit welding of the deck structure and support structure together, wherein the pistons (1) are prevented from moving into the respective deck legs (5) during the weight transfer by mechanically locking the pistons (1) in the deck legs by means of a mechanical one-way ratchet type mechanism, thus permitting the deck structure to be raised with respect to the support structure in the course of said weight transfer.

22. A method for removal of a deck structure at an offshore location, where the deck structure is located on the top of a support structure having legs (13) standing on the sea bottom ready to start the removal operation by a vessel which is positioned underneath the deck structure and without interfering with the legs of the support structure, wherein the deck structure is fitted with a plurality of jack type mechanisms with an associated piston (1) located in a deck node (14) in the bottom of the deck structure, in that each of said pistons (1), while being in the ratching mode, is brought into contact with the vessel (12) directly on a deck support structure stool or, alternatively, on a deck support unit DSU (15) located on the vessel deck support structure (16), upon which and still in the ratching mode, the piston is maintaining contact with the vessel (12) through the wave induced downward motion of the vessel, thus avoiding any separation of the structures, and upon start of the subsequent upward wave induced movement of the vessel, the ratchet type mechanism with its associated piston (1) will enter a locking mode of operation, locking the deck structure in its upper position relative to the vessel, and start transferring the load quickly from the deck node (14) onto the vessel (12) with reduced shock-loads, and where subsequent wave motions with larger amplitudes than the earlier may further increase the load transfer and increase the distance between the vessel and the deck structure, enabling the completion of the remaining part of the load to be transferred through subsequent deballasting and finally undocking of the vessel.

* * * * *